US007950662B2

(12) United States Patent
Robinson

(10) Patent No.: US 7,950,662 B2
(45) Date of Patent: May 31, 2011

(54) SEAL CARD GAME WITHOUT EARLY BONUS ROUND ELIMINATION

(75) Inventor: Dana Robinson, Seattle, WA (US)

(73) Assignee: Arrow International, Inc., Cleveland, OH (US)

( * ) Notice: Subject to any disclaimer, the term of this patent is extended or adjusted under 35 U.S.C. 154(b) by 0 days.

(21) Appl. No.: 12/274,845

(22) Filed: Nov. 20, 2008

(65) Prior Publication Data

US 2009/0127779 A1 May 21, 2009

Related U.S. Application Data

(60) Provisional application No. 60/989,511, filed on Nov. 21, 2007.

(51) Int. Cl.
*A63B 71/00* (2006.01)

(52) U.S. Cl. ..... 273/139

(58) Field of Classification Search ..... None
See application file for complete search history.

(56) References Cited

U.S. PATENT DOCUMENTS 5,046,737 A 9/1991 Fienberg
5,407,200 A 4/1995 Zalabak
5,540,441 A * 7/1996 Ilan et al. ..... 273/269
5,743,524 A * 4/1998 Nannicola ..... 273/139
6,612,576 B1 * 9/2003 Stancik et al. ..... 273/139
6,824,135 B2 * 11/2004 Stancik ..... 273/139
6,923,440 B2 8/2005 Cherry
7,055,823 B2 * 6/2006 Denkewicz, Jr. ..... 273/304

* cited by examiner

*Primary Examiner* — Gene Kim
*Assistant Examiner* — Dolores Collins
(74) *Attorney, Agent, or Firm* — Fay Sharpe LLP

(57) ABSTRACT

A system for playing a game of chance includes a plurality of playing cards, each of the playing cards displaying game symbols thereon. At least some of the plurality of playing cards display an eligible game symbol for participation in bonus levels of play. A master game card is provided for use in conjunction with the playing cards. The master game card includes a plurality of playing areas, each playing area representing a playing level. In each playing area, one or more of the eligible game symbols are included as a bonus level game symbol for the respective level of play. In each successive level of play, more of the eligible game symbols are identified as bonus level game symbols. Cover members conceal the bonus level game symbols prior to play. By opening one of the cover members at each level in turn, a winning one of the eligible game symbols is revealed. By including all of the eligible game symbols from the previous level, players are not aware of being eliminated until the final level of play is reached, thereby maintaining interest in the game.

9 Claims, 5 Drawing Sheets

SEAL CARD GAME WITHOUT EARLY BONUS ROUND ELIMINATION

This application claims the priority of U.S. Provisional Application 60/989,511, filed on Nov. 21, 2007, the disclosure of which is incorporated herein in its entirety, by reference.

BACKGROUND

The present exemplary embodiment relates to gaming systems and, more particularly, to a lottery-type gaming system. It will be described with particular reference to a seal card gaming system. However, it is to be appreciated that the present exemplary embodiment is also amenable to other like applications.

Lottery-type games of chance have exhibited enduring popularity since such games typically permit a player to make a relatively small investment—by buying a ticket—with a chance of winning a significantly larger award. In addition to the entertainment value that such games provide for the players, these types of games typically provide a source of revenue for the operator, normally a charity, but sometimes a municipality or a business establishment.

One type of game system which has proven quite popular with players is the so-called break-open ticket game. In this type of game, players purchase playing cards for a relatively nominal sum, with each playing card displaying game symbols, selected ones of which correspond to award values. In a typical configuration, each playing card comprises a lamination of upper and lower plies of material, such as paper, with the game symbols displayed on the inside surface of the lower ply. The game symbols are thus initially concealed, and are revealed by "breaking open" one or more flap-like portions of the upper ply.

Some of lottery-type games provide multiple levels of play, including an arrangement whereby selected players become eligible for a bonus award. In such games, some of the playing cards display an eligible game symbol. A master game card is provided for use in conjunction with the playing cards and may provide several of rounds of play. In one known such multiple level game, successively fewer players have a chance at winning a bonus award. As a result, players who have been knocked out in an earlier round lose interest in the game.

It has, therefore, been considered desirable to develop a new and improved seal card game and method for playing same which would overcome the above stated disadvantages and others and keep the interest of all the players involved in the bonus rounds.

BRIEF DESCRIPTION

In accordance with one aspect of the exemplary embodiment, a system for playing a game of chance is provided. The system includes a plurality of playing cards, each of the playing cards displaying one or more symbols thereon, at least some of the plurality of playing cards displaying an eligible game symbol for participation in bonus levels of play. A master game card is provided for use in conjunction with the playing cards. The master game card includes a plurality of playing areas, each playing area representing a playing level. In each of the playing areas, at least one of the eligible game symbols is identified as a bonus level game symbol in the respective level of play. In each successive level of play, a greater number of the eligible game symbols are identified as bonus level game symbols in the respective playing area than for the preceding level. Game symbol cover members may conceal the bonus level game symbols prior to play.

In another aspect, a method of playing a game of chance includes distributing a plurality of playing cards, each of the playing cards displaying one or more symbols thereon, at least some of the plurality of playing cards displaying an eligible game symbol for participation in bonus levels of play. The method further includes playing a first bonus level of play in which one of the eligible game symbols is uncovered as a winning game symbol and playing at least one subsequent level of play in which the eligible game symbol which was uncovered as a winning game symbol in the first level of play has an opportunity of being uncovered again as a winning game symbol in the second bonus level of play.

In another aspect, a gaming system, which provides multiple levels of play, includes a plurality of playing cards, each of the playing cards including at least one game symbol displayed thereon. At least one of the playing cards displays a winning game symbol. A master game card is provided for use in conjunction with the plurality of playing cards, the master game card including a plurality of playing areas representing a plurality of playing levels. The master game card includes a first playing area representing a first playing level. The first playing area includes indicia having one winning game symbol. A second playing area represents a second, successive, playing level. The second playing area includes indicia having two different winning game symbols. Each successive playing area representing a successive playing level includes indicia having one additional different winning game symbol than an immediately previous playing area.

In another aspect, a seal card game including a plurality of playing cards and a master game card is provided with a multiple level bonus round in which no bonus round player is eliminated before a final level of play.

In another aspect, a method of playing a game of chance is provided with a multiple level bonus round in which no bonus round player is eliminated before a final level of play.

In another aspect, a game is provided with a first round and a multiple level bonus round in which each bonus round player is eligible at successive levels of the bonus round.

In another aspect, a lottery game is provided with a first, instant win, round and a sign up bonus round with multiple levels, in which at least one additional player becomes eligible at each successive level of the bonus round.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION

Figure 1:
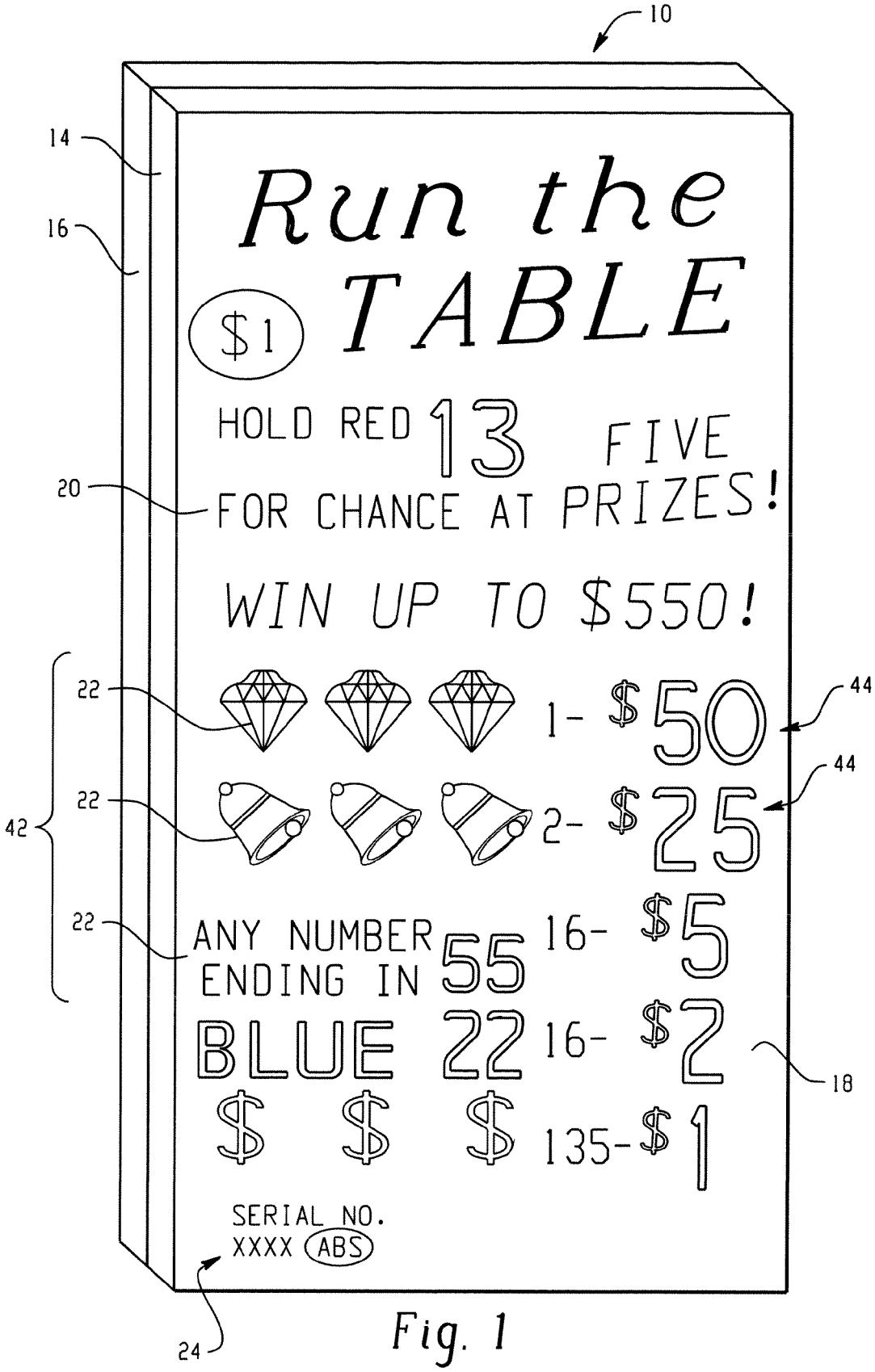
FIG. 1 is a top plan view of a front face of a playing card for a seal card game system according to one aspect of the present invention.

While this invention is susceptible of embodiment in many different forms, there is shown in the drawings and will herein be described in detail, several preferred embodiments of the invention. However, it should be understood that the Figures are to be considered only as exemplifying the principles of the invention and are not intended to limit the invention to the embodiments illustrated.

In one aspect, the system includes a plurality of playing cards, each of the playing cards displaying game displaying one or more symbols thereon. At least some of the plurality of playing cards display an eligible game symbol for participation in bonus levels of play. A master game card is provided for use in conjunction with the playing cards. The master game card includes a plurality of playing areas, each playing area representing a playing level. In each of the playing areas, sections, such as windows, are provided for identifying at least one of the eligible game symbols as a bonus level game symbol in each of the plurality of levels of play. In each successive level of play, a greater number of the eligible game symbols are identified as bonus level game symbols. Cover members are provided for concealing the bonus level game symbols prior to play.

Instructions may be provided with the system for playing the game. Such instructions can indicate which is the first level and instructions that only a single one of the cover members in each level is opened or otherwise removed to reveal one of the bonus level game symbols as a winning game symbol, starting with the first level.

In each successive level of play, all of the bonus level game symbols of the previous level may be included, together with at least one additional game symbol.

In various aspects of the instant disclosure, some of the game symbols on the playing cards may comprise instant win game symbols. The cover members on the master game card may include flaps. One flap may be provided for each bonus level game symbol.

According to another aspect hereof, a method of playing a game of chance includes providing the exemplary system described above with instructions for play.

According to another aspect hereof, a method of playing a game of chance includes distributing a set of playing cards to a plurality of players. At least one cover member on each of the playing cards is removed to reveal game symbols, at least some of said plurality of playing cards including an eligible game symbol, which entitles a holder of the playing card to be eligible to participate in bonus levels of play. The method includes playing a first bonus round of play in which one of the eligible game symbols is uncovered as a winning game symbol and playing at least one subsequent round of play in which the eligible game symbol which was uncovered as a winning game symbol in the first round of play has an opportunity of being uncovered as a winning game symbol in the second bonus round of play.

In aspects of the exemplary method, at each subsequent bonus round of play, at least one additional eligible game symbol has an opportunity of being uncovered as a winning game symbol in that bonus round of play. At each round of play, each of the eligible game symbols from the previous round may have a chance of being uncovered as a winning game symbol. At each successive round, only one of the eligible game symbols may be uncovered as a winning game symbol.

Figure 2:
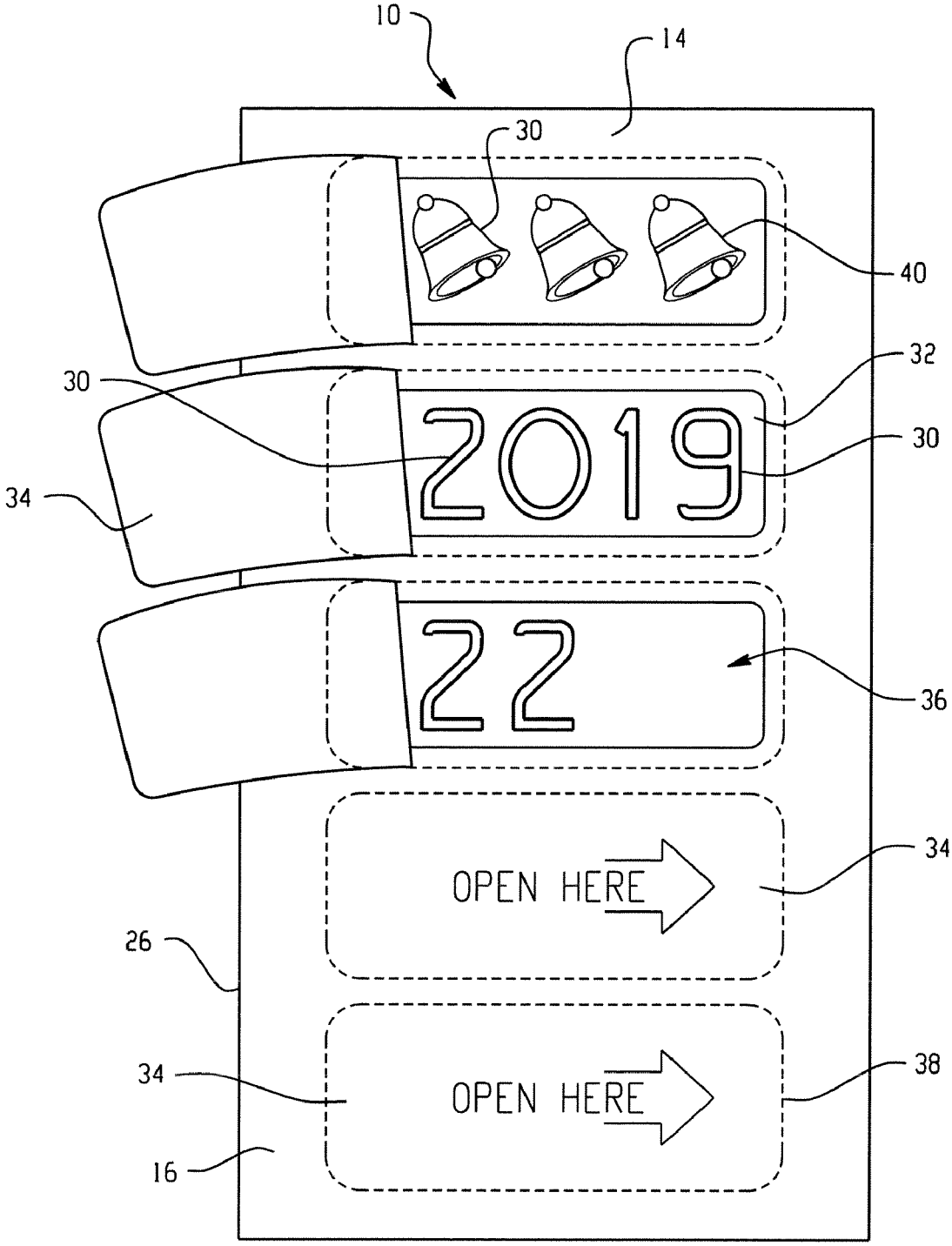
FIG. 2 is a top perspective view of a rear face of the playing card of FIG. 1 with three flaps opened.
Figure 3:
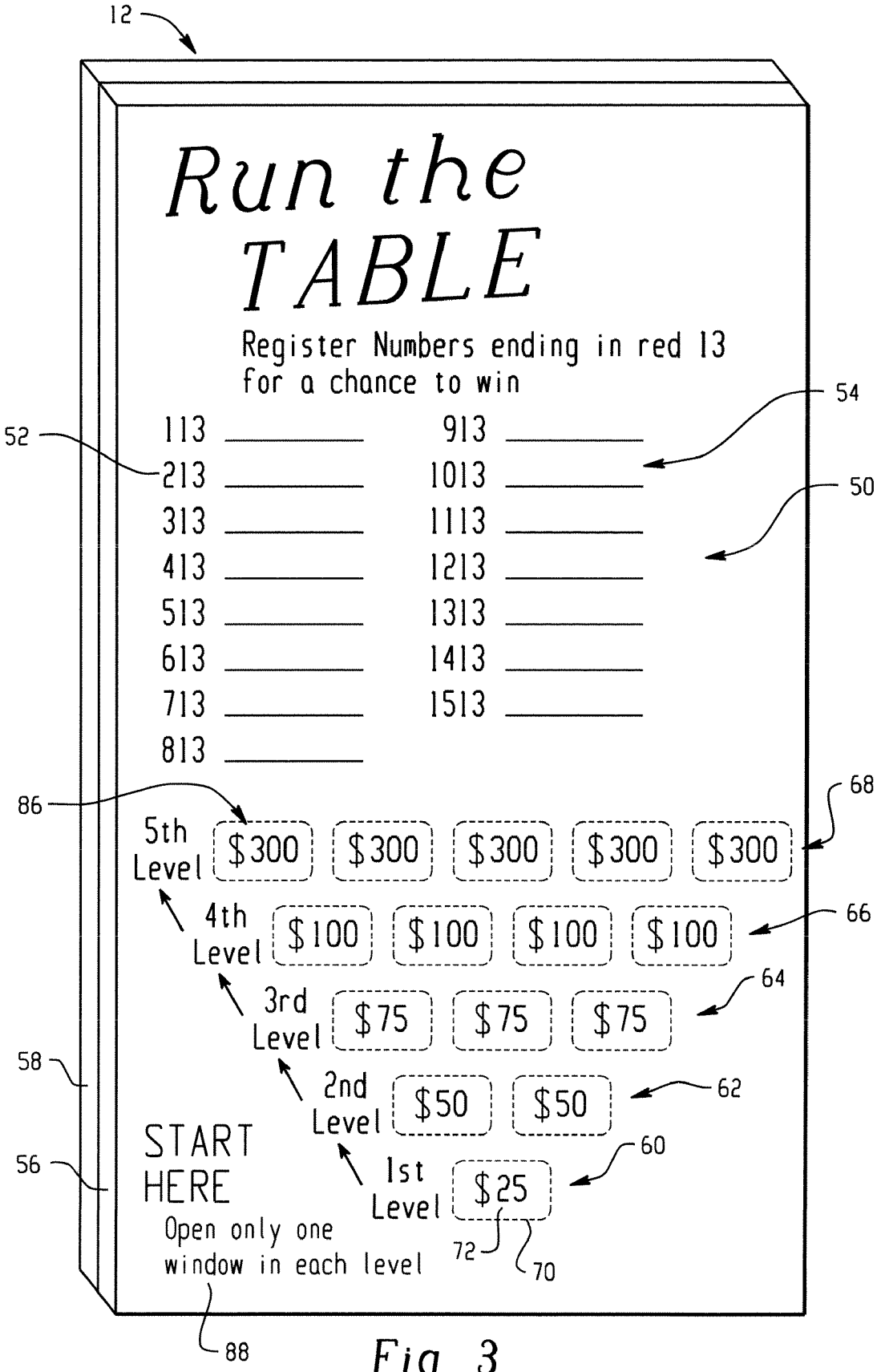
FIG. 3 is a top plan view of a master game card for use in combination with the playing card of FIG. 1 in a seal card game system according to one aspect of the present invention.

FIGS. 1 and 2 illustrate playing cards or tickets 10 and FIG. 3 illustrates a master game card 12. A plurality of the playing cards 10 and master game card 12 are used in combination for playing a game of chance, namely a multi-level game system according to the present exemplary embodiment. Certain ones of the players are eligible to participate in the selection of bonus awards on the master game card 12. While the game is described with reference to a first "instant win" level of play followed by a bonus round with five levels of play, it will be appreciated that the instant win level may be modified and any number of bonus round levels may be used, for example, two, three, four, or more than five bonus levels of play. In general, it is contemplated that there will be at least three bonus levels of play.

Playing card 10 is intended as exemplary, in that the present game system includes a substantial number of such playing cards. In one embodiment, for example, between about 300 and about 2,000 cards can be employed. Each of the playing cards 10 is purchased by a game player for a nominal sum, such as $1. The playing card price can be printed on the card 10, although it is also contemplated that a game organizer may be free to set the playing card price and thus determine the total profit accordingly.

The playing cards 10 are generally packaged as a set or deal, in a clear wrapping (not shown), together with the master game card 12. By having a fixed number of cards 10 in the set of playing cards and bonus tickets, the total payout and the profit to the organizer can be predetermined (assuming all playing cards 10 in the set are sold). Additionally, the playing cards 10 can be assembled such that the total payout is the same for each deal.

As shown in FIG. 1, each of the playing cards 10 may comprise upper and lower layers or plies 14 and 16 of material, laminated together at the edges of their inner surfaces, and formed from paper, card, or the like. An outer, first face 18 of one of the plies 14 may be used to display information about the game, such as the rules of the game 20, examples of winning combinations 22 of "instant win" symbols, and the like (see FIG. 1). The price of each playing card ($1.00 in the illustrated embodiment) is also printed on the first face 18 or elsewhere on the playing card 10. Alternatively, the first face may be left blank. An identifying character 24, such as a serial number, is optionally printed on the front face 18 or a rear face 26 (FIG. 2) of the card 10 for identifying the playing card 10 as being part of the set of playing cards, all with the same serial number and associated with a corresponding serial number printed on the master game card 12. This avoids the instance of a player from a previous game trying to collect an award in a subsequent game using the same card 10 or ticket 12.

With particular reference to FIG. 2, each of the playing cards 10 displays at least one, more generally, a plurality of game symbols 30. The symbols 30 may be letters, numbers, and/or characters, such as fruit, diamonds, dollar signs, crowns, bells, and the like commonly associated with lottery games. Such symbols may be arranged singly, or in groups. Each of the cards 10 includes a plurality of cover members or a single cover member. The cover member may be a flap or flaps or a scratch-off or peel off layer. Preferably, the symbols 30 are displayed on an inside surface 32 of the upper ply 14 of the card. This type of card 10 is typically referred to as a "break-open" playing card, in that the cover member comprises one or more flap-like portions 34 of the lower ply 16 (five flaps 34 for each card 10 are shown in FIG. 2) which each cover one or more game symbols 30. The flaps 34 can be selectively opened (e.g., peeled away from the card 10) in order to reveal windows 36 displaying the respective one or group of game symbols 30 beneath, after the card has been purchased. The flaps 34 have perforated edges 38, allowing them to be readily separated from the surrounding upper ply material.

In its first, "instant win" level of play, some of the game symbols are "immediate win" symbols 40 (such as the row of bells illustrated). The immediate win symbols are those symbols which identify an immediate instant winner. To assist players in ascertaining winning cards at the first level of play, a listing 42 of the winning groups of immediate win award symbols is provided on the front face (FIG. 1) of each playing card and/or the master game card. The present game system provides awards 44 to those players having cards which display a predetermined immediate win winning symbol or combination of award symbols. In the embodiment shown in FIG. 1, by way of example, a winning group of award symbols 40 comprising three bells wins a $25 award 44 instantly; three diamonds wins $50; while a group of numbers ending in blue 22 wins $2, and so forth. The playing card holder compares the symbol or groups of symbols under each flap 34 with the different groups of immediate win award symbols on the listing 42 to determine whether the playing card is an immediate-winning playing card. FIG. 1 exemplifies an immediate win card 10 having a group of three bells under one of the flaps 34. An immediate-win game player takes the winning playing card 10 to a game organizer and receives the winning amount accorded to the particular winning symbol or group of symbols 40 (FIG. 1).

In another embodiment, the immediate win symbols are not used.

Figure 4:
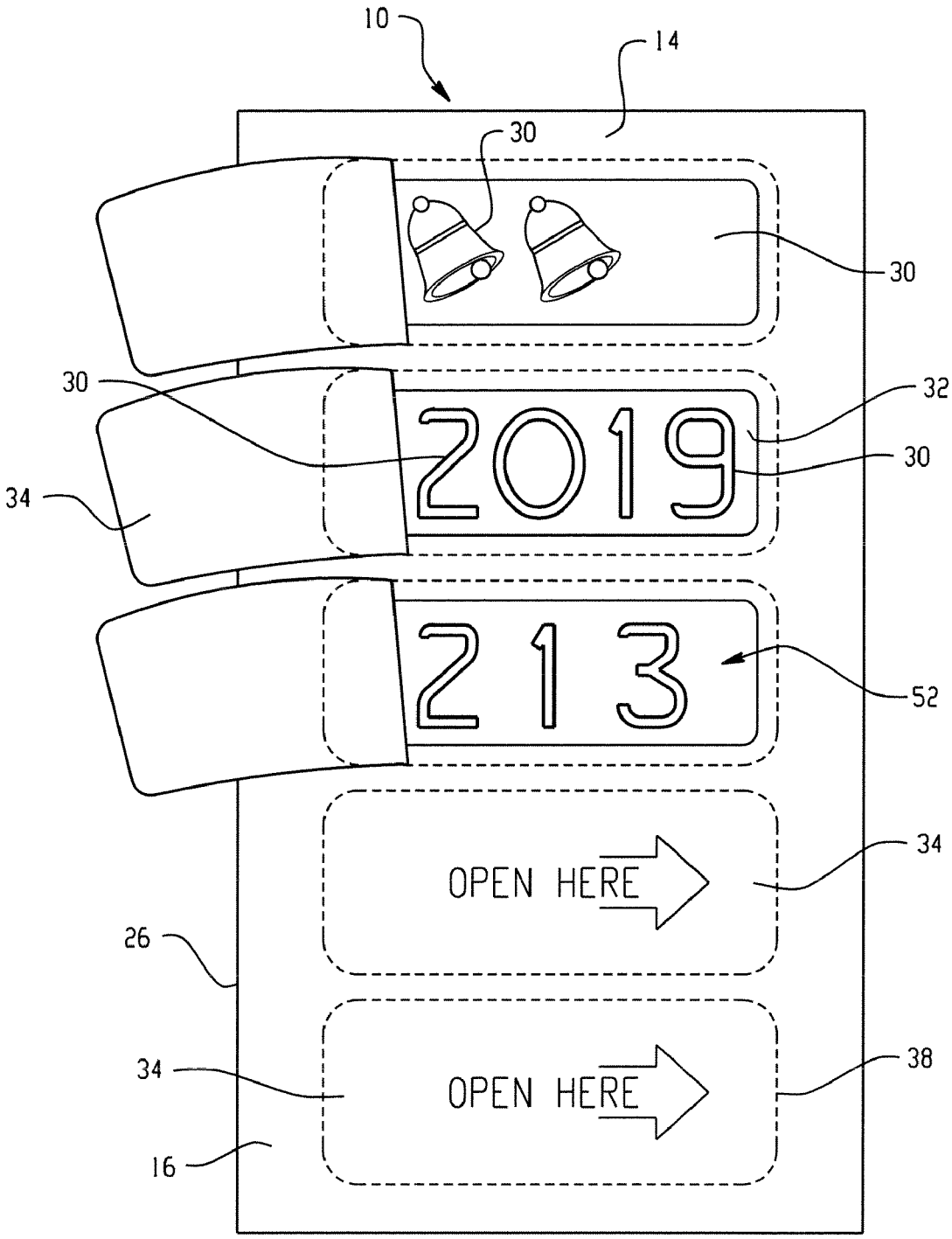
FIG. 4 is a top perspective view of a rear face of a playing card illustrating an eligible game symbol.

In its additional, bonus levels of play, the present system permits selected ones of the players to become eligible for a plurality of bonus awards through use of the master game card 12. The bonus levels of play of the present game system entail establishing selected game players who become eligible for a plurality of bonus awards, with these players then listed on the master game card 12 in the illustrated embodiment. To this end, the master game card 12 includes a sign up area 50, for listing the selected, eligible players (FIG. 3). The eligibility of these selected players is established by those players having cards having a predetermined selected one (or more) of the eligible game symbols. In the illustrated embodiment, such predetermined eligible game symbols 52 comprise numeric designations ending in a red 13 (i.e., 113, 213, 313, etc.). FIG. 4 exemplifies a playing card 10 which reveals the eligible symbol 52 (the number 213) under one of the flaps 34. Other characters could alternatively be used in place of the numerals preceding the number 13. Each of the eligible game symbols 52 is printed on one of the game playing cards. In the illustrated embodiment, fifteen of the cards 10 in the set have eligible game symbols printed thereon, although in other embodiments, there may be fewer or more than fifteen. In general, there may be at least ten cards 10 with eligible game symbols 52 thereon among the set of cards.

Upon opening a flap 34 to reveal an eligible game symbol or group of symbols forming an eligible game symbol 52 (both will be referred to hereinafter simply as eligible game symbols), the game player can enter his name on the sign up area in the appropriate location (e.g., adjacent his eligible symbol 52). In the embodiment of FIG. 3, for example, the fifteen eligible game symbols 52, all ending in the numerals "13", are contained within sign-up area 50 and are thus identified as being eligible game symbols 52.

Associated with each eligible game symbol 52 of sign-up area 50 is a name region 54. Each name region 54 provides space for the recordation of the name, or other indicia, identifying the holder of a playing card 10 which displays the associated eligible game symbol 52.

As shown in FIG. 3, the master game card 12 can comprise a lamination of upper and lower plies of material 56 and 58. As with the playing cards 10, such a construction allows flaps to be opened on the master game card. The master game card 12 further includes an arrangement whereby a selected one (or more than one) of the listed, eligible players is identified as a winner in each of the bonus levels of play.

The master game card 12 is shown in FIG. 3 as including five bonus playing levels, arranged in playing areas, such as horizontal rows: a first playing level 60, which is the lowermost row in the illustrated embodiment, a second playing level 62, a third playing level 64, a fourth playing level 66, and a fifth playing level 68, which is shown as the uppermost row. In the illustrated embodiment, the master game card 12 includes at least one award identifier 70, which is associated with each of the bonus levels. At least one bonus level game symbol is associated with each award. The award identifier 70 identifies an award 72 or awards for the particular level of play. In the illustrated embodiment, the amount of the award increases with each successive level, such that the final (here fifth) level is associated with the highest award 72 ($300 in the illustrated embodiment).

Figure 5:
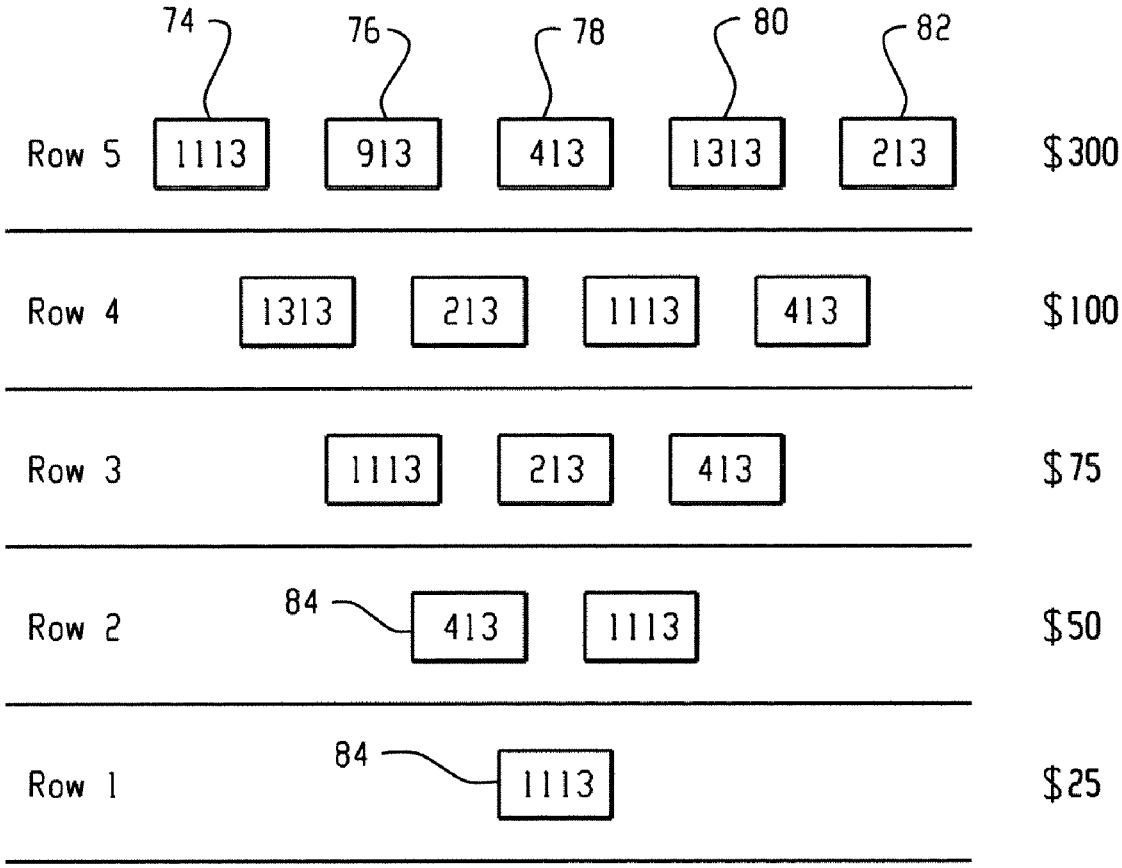
FIG. 5 is a top plan view of the lower ply of the master game card of FIG. 3 (i.e., simulating the master game card with the flaps open).

In the embodiment illustrated in FIG. 5, there are five unique bonus level game symbols 74, 76, 78, 80, 82 shown. These have numerical designations 1113, 913, 413, 1313, and 213, as shown.

In general, the number of bonus level game symbols may equal the number of rows (bonus levels) 60, 62, 64, 66, 68. Of course, other geometric schemes are also contemplated. For example, the first level can have one window, the second level three windows, the third level five windows, and so on. In such a design, a number of bonus level game symbols would be greater than the number of rows. Also, each bonus level game symbol may be represented no more than once in any row.

In the embodiment of FIG. 5, the five unique bonus level game symbols 74, 76, 78, 80, 82 are all present in the final level of play. Each preceding level contains one fewer bonus level game symbol than its respective immediately subsequent playing level, such that in the first bonus level, only one bonus level game symbol is present. For example, as shown in FIG. 5, symbol 76 (the number 913) is absent from the fourth row, third row, second row, and first row. Symbol 80 (the number 1313) is absent from the third row, second row, and first row. Symbol 82 (the number 213) is absent from the second row, and first row. Typically, the bonus level game symbols 74, 76, 78, 80, 82 represent fewer than all of the eligible game symbols 52. Thus, in the illustrated embodiment, the sign up area 50 includes more game symbol designations than the five bonus level game symbols used in the five levels of play. Specifically, five of the fifteen bonus level players have a chance of winning at the bonus level. Of course, the fifteen players do not know which five could win, thus keeping all fifteen of them interested in the game.

In the illustrated embodiment, the bonus level game symbols 74, 76, 78, 80, 82 are printed in windows 84 (FIG. 5) on an upper surface of the lower ply 58 of the master game card 12 (FIG. 3). The bonus level game symbols are each covered by a cover member 86, such as a perforated flap similar to those on the playing cards 10. It should be appreciated that other types of cover members, such as the scratch-off portions are also contemplated. The flap 86 is formed in the top ply 56 of the master game card 12 and can be pulled away to reveal the bonus level game symbol hidden beneath. The award 72, such as a monetary amount, may be printed on a top surface of the flap 86, as shown in FIG. 3, or elsewhere on the master game card 12 or on playing cards 10.

Instructions 88 may be provided with the system for playing the game, including instructions which specify that only a single one of the cover members in each level is opened, starting with the first level. The instructions may further clearly indicate which row corresponds to the first level 60, e.g., by indicating where to start, and so forth. In the illustrated embodiment, the instructions are on the maser game card, although it is also contemplated that the instructions may be provided separately, such as on an instruction sheet or on the playing cards.

Play may proceed as follows. Initially, the flaps 86 on the master game card 12 are in a closed position, covering the associated bonus level game symbols 74, 76, 78, 80, 82, as shown in FIG. 3. Playing cards 10 are distributed to players who become holders of the playing cards (it is of course contemplated that a player may give one or more of his playing cards to another person who then becomes the holder). If the present gaming system is being employed for fundraising purposes, each player will purchase one or more playing cards for a predetermined price, $1.00 in the illustrated embodiment. The players are provided with time to open their flaps 34 and collect any instant win awards. The names of the holders of playing cards displaying eligible game symbols 52, which, in the illustrated embodiment, are game symbols ending in the numeric designation "13", can be recorded within the sign-up area 50 at any time throughout this period.

Then, the game proceeds to the bonus round. The single flap 86 for the first row 60 on the master game card 12 is opened, e.g., by the game operator, in order to reveal a window 84 with one of the bonus level game symbols (symbol 74 in the illustrated embodiment) displayed beneath or information sufficient to identify the bonus level game symbol as a winning game symbol. The player whose number is revealed wins the corresponding award 72 for that bonus round level, which may be a sum of money ($25 in the illustrated embodiment). The bonus level game symbol 74 for the first bonus round level is also present in a window of all the subsequent bonus levels 62, 64, 66, 68. Thus, the player whose number is revealed has a chance of winning a further award in each of the subsequent levels.

Play then proceeds to the second level. The player with the first round bonus level game symbol 74 selects a window in the second row 62. The second row has at least one additional window 84 to that in the first level (two windows in the illustrated embodiment). The flap 86 over one of these windows conceals the same game symbol 74 (number 113) as did the first row 60, while the other flap conceals a different game symbol (number 413 in the illustrated embodiment) selected from the group of eligible game symbols 52. If the player happens to open the flap which conceals his own eligible game symbol as the bonus level game symbol, he wins again ($50 in the illustrated example). If the other number is selected, the player with that bonus level game symbol wins the award for the second level.

Play then proceeds to the third level 64. The player whose bonus level game symbol was revealed in the second level is given the opportunity to open one of the third level windows. The third level has at least one window in addition to the second level windows (three in the illustrated embodiment). The windows include all the bonus level game symbols present in the first and second levels (here, numbers 413 and 113), plus at least one additional bonus level game symbol (e.g., the number 213).

Play continues in this fashion through each of the game levels 64, 66, 68, with one window being opened in each row by the winner of the previous bonus round level. Thus, five different numbers are possible winners of the top prize ($300 in the illustrated embodiment). Furthermore, from the perspective of the players, any of the sign-up numbers 52 could win the prize in any given row. In this way, no player holding a card 10 with an eligible game symbol is aware of being eliminated until the final level of play occurs. In each playing set of the exemplary gaming system, the master game card differs from master game cards in other playing sets, so none of the hidden numbers 74, 76, 78, 80, 82 are known until the flaps 86 revealing the numbers are opened.

The holder of the playing card 10 with the winning symbol for each row collects the associated award from the organizer. In general, the value of the award 72 increases with each successive level, such that the award for the final level 68 is substantially greater than for the first level 60.

In the exemplary embodiment illustrated, for any variation of the master game card, the fifteen total windows hold five of one number, four of a second number, three of a third number, two of a fourth number and one of a fifth number. Put another way, each row of the windows 86 contains all the numbers in the previous row plus one new number. As a result, it is possible for any winner to win all the remaining rows in the game, thus "running the table." Since an eligible game symbol 52 is added at each level, none of the fifteen sign-ups are eliminated (from the players' perspective) until the final prize is determined. In fact, a winner of one row can lose the following row then win again in one or more of the remaining rows.

In the example in FIG. 5, number 1113 wins $25 then picks one of the two windows in the second row. Either number 413 or number 1113 wins $50, then picks one of the three windows in the third row. Any one of numbers 1113, 213, and 413 wins $75 then picks one of the four windows in the fourth row. Any one of numbers 1313, 213, 1113, and 413 wins $100 then picks one of the five windows in the fifth row. One of numbers 1113, 913, 413, 1313, and 213 wins $300.

As will be appreciated, variations on the game may be provided, e.g., at the discretion of the operator. For example, the operator may decide to allow more than one window to be opened at a given level. In such cases, the award may be split among the players whose numbers are revealed.

Although, in the illustrated embodiment, bonus level game symbol concealment is achieved through the use of a two-ply master game card construction, the bonus level game symbol cover members 86 may have numerous alternative configurations. For example, master game card 12 may comprise only a single ply construction, with the bonus level game symbol cover members 86 comprising a flap-like member affixed to master game card 12 along one or more sides of the flap-like member. Alternatively, the bonus level game symbol cover members 84 may comprise a removable opaque substance, such as conventionally known "scratch-off" material.

The assembled game system can include a set of playing cards 10, a master game card 12, and a printed set of instructions for play (not shown). The instructions may include information about the payout, which can be a definite payout, when all of the cards are sold. The profit for the game organizer can also be displayed, based on the total income from the cards and the definite payout, optionally also taking into account the cost to the organizer of the set of cards.

The award amounts and number of playing cards and bonus tickets in the deal can be tailored to meet the requirements of different game organizers. For example, one version of the game may have 1680 playing cards, for organizers of large games, another, 1140 playing cards for a smaller game, and so forth. The versions may all have different total payouts, and may also have different percentage payouts. It may be desirable for the payout percentage to be the same or approximately the same in the various versions of the game so that players and the game organizer are familiar with the expected awards. The instructions may also contain information about the numbers of multiple winners and the payouts for the multiple winners.

As will be appreciated, variations of the present system can be made within the purview of the present invention. As noted, the playing cards 10 can be otherwise configured, as can the master game card 12. If desired, fewer or more than the disclosed levels of play can be provided. Additionally, plural arrangements can be provided for establishing the eligibility for bonus play of selected players. For example, two listings of eligible players can be provided on the master game card, with two different criteria identified for establishing eligibility. The playing card 10 is exemplary of the present invention in that the present game system includes a plurality of such playing cards such as, for example, in the illustrated embodiments, about 1140 cards or 1680 cards. Each of these playing cards 10 is separately purchased by a game player. Aspects of other lottery type games may be incorporated, such as bonus tickets, as disclosed, for example, in U.S. Pat. No. 6,612,576, or a raffle, as disclosed for example, in U.S. Pat. No. 6,923,440. The disclosures of both of these patents are incorporated herein by reference in their entireties.

Aspects of the invention have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

I claim:

1. A method of playing a game of chance, comprising:

providing a system for playing a game of chance comprising:

a plurality of playing cards, each of the playing cards displaying one or more symbols thereon, at least some of the plurality of playing cards displaying an eligible game symbol for participation in bonus levels of play; and a master game card for use in conjunction with the playing cards, the master game card including a plurality of playing areas, each playing area representing a playing level, in each of the playing areas at least one of the eligible game symbols is identified as a bonus level game symbol in the respective level of play, in each successive level of play, a greater number of the eligible game symbols are identified as bonus level game symbols in the respective playing area than for the preceding level; distributing the plurality of playing cards to players;

identifying players holding playing cards displaying an eligible game symbol; and with the master game card, playing a plurality of bonus levels of play, comprising:

in a first of the bonus levels of play, uncovering a single one of the eligible game symbols in a first playing area to identify a winner of the first bonus level; and in each successive bonus level of play, uncovering at least one of the eligible game symbols in a respective playing area to identify at least one winner of the respective successive bonus level of play.

2. The method of claim 1, further comprising:

providing an award to the winner of the first bonus level of play; and providing at least one award to the at least one winner of each of the respective successive bonus levels of play.

3. The method of claim 1, wherein at each subsequent bonus level of play, at least one additional eligible game symbol has an opportunity of being uncovered as a winning game symbol in that bonus level of play.

4. The method of claim 1, wherein at each level of play, each of the eligible game symbols from the previous level has a chance of being uncovered as a winning game symbol in a successive level.

5. The method of claim 1, wherein at each successive level, no bonus level player is eliminated before a final level.

6. A method of playing a game of chance comprising:

distributing a plurality of playing cards, each of the playing cards displaying one or more symbols thereon, at least some of the plurality of playing cards displaying an eligible game symbol for participation in bonus levels of play;

providing a master game card for use in conjunction with the playing cards, the master game card including a plurality of playing areas, each playing area representing a playing level, in each of the playing areas at least one of the eligible game symbols is identified as a bonus level game symbol in the respective level of play, in each successive level of play, a greater number of the eligible game symbols are identified as bonus level game symbols in the respective playing area than for the preceding level; and with the master game card:

playing a first bonus level of play in which one of the eligible game symbols is uncovered as a winning game symbol, in a first of the playing areas on the master game card; and playing at least one subsequent level of play in which the eligible game symbol which was uncovered as a winning game symbol in the first level of play has an opportunity of being uncovered again as a winning game symbol in the second bonus level of play, in a second of the playing areas on the master game card.

7. The method of claim 6, wherein at each subsequent bonus level of play, at least one additional eligible game symbol has an opportunity of being uncovered as a winning game symbol in that bonus level of play.

8. The method of claim 6, wherein at each level of play, each of the eligible game symbols from the previous level has a chance of being uncovered as a winning game symbol in a successive level.

9. The method of claim 6, wherein at each successive level, no bonus level player is eliminated before a final level.

* * * * *